US005657911A

United States Patent [19]

Mogler et al.

[11] Patent Number: 5,657,911

[45] Date of Patent: Aug. 19, 1997

[54] TAP HEAD FOR KEG FITTINGS

[75] Inventors: Joachim Mogler, Austrasse 34 74076, Heilbronn, Germany; Helmut Wiedmann, Heilbronn, Germany

[73] Assignee: Joachim Mogler, Heilbronn, Germany

[21] Appl. No.: 500,852

[22] PCT Filed: Feb. 3, 1994

[86] PCT No.: PCT/EP94/00310

§ 371 Date: Aug. 4, 1995

§ 102(e) Date: Aug. 4, 1995

[87] PCT Pub. No.: WO94/18112

PCT Pub. Date: Aug. 18, 1994

[30] Foreign Application Priority Data

Feb. 6, 1993 [DE] Germany ..... 43 03 461.6

[51] Int. Cl.[6] ..... B65D 83/00

[52] U.S. Cl. ..... 222/400.7; 222/153.14

[58] Field of Search ..... 222/400.7, 153.14, 222/394; 137/614.04

[56] References Cited

U.S. PATENT DOCUMENTS 5,511,692 4/1996 Willingham ..... 222/400.7 X

FOREIGN PATENT DOCUMENTS 2939536 4/1981 Germany .
3701432 7/1987 Germany .
3902527 6/1990 Germany .
9110371 10/1991 Germany .

*Primary Examiner*—Gregory L. Huson
*Attorney, Agent, or Firm*—Shenier & O'Connor

[57] ABSTRACT

A tap head for keg fittings comprises a sliding guide means containing an annular seal and a guideway for pushing the tap head onto the protruding rim of a plate of the keg fittings, wherein at least the sliding guide means of the tap head consists of spring elastic material and a projecting guide piece of the guideway engages under the rim of the plate. The modulus of elasticity of the material forming the sliding guide means and the geometry and the dimensions of the guide piece are determined such that the guide piece undergoes deformation at a predetermined gas pressure in the housing of the tap head and a gap for the release of excess gas pressure is formed between the plate and the annular seal.

3 Claims, 4 Drawing Sheets

TAP HEAD FOR KEG FITTINGS

The invention relates to a tap head for keg fittings according to the preamble to patent claim 1.

A tap head of this type is known from DE-PS 39 02 527.

Provision of a pressure relief valve which opens when there is a predetermined excess gas pressure in the keg and tap head to prevent explosion-like bursting of the barrel-like keg and the tap head in the event of excessive gas pressure is often desired and sometimes also prescribed by the authorities for such tap heads. Known pressure relief valves (DE-OS 29 39 536) for this purpose are designed as separate components which have to be manufactured separately and inserted subsequently in a sealed state into a wall of the tap head housing.

The object of the invention is to so design a generic tap head that release of an inadmissibly high excess gas pressure in the keg and tap head is possible without using a separate pressure relief valve.

The object is accomplished with a generic tap head by the features in the characterizing clause of patent claim 1.

It is known from DE-OS 37 01 432 to allow pressure gas to escape through a gap between a plate on the barrel and an annular seal on the tap head with the shut-off valves of a tap head in the closed state. However, the known configuration cannot be used as a pressure relief valve. In a tap head of a different type, DE-GM 91 10 371 shows a sliding guide means for barrel fittings which is placed as a separate component on the tap head housing.

Preferred embodiments of the invention are the subject matter of subclaims 2 and 3.

The following description serves to explain the invention in greater detail in conjunction with the attached drawings, in which FIG. 1 is a part-sectional side view of a tap head for keg fittings with a sliding guide means in the normal operating state;

Figure 1:
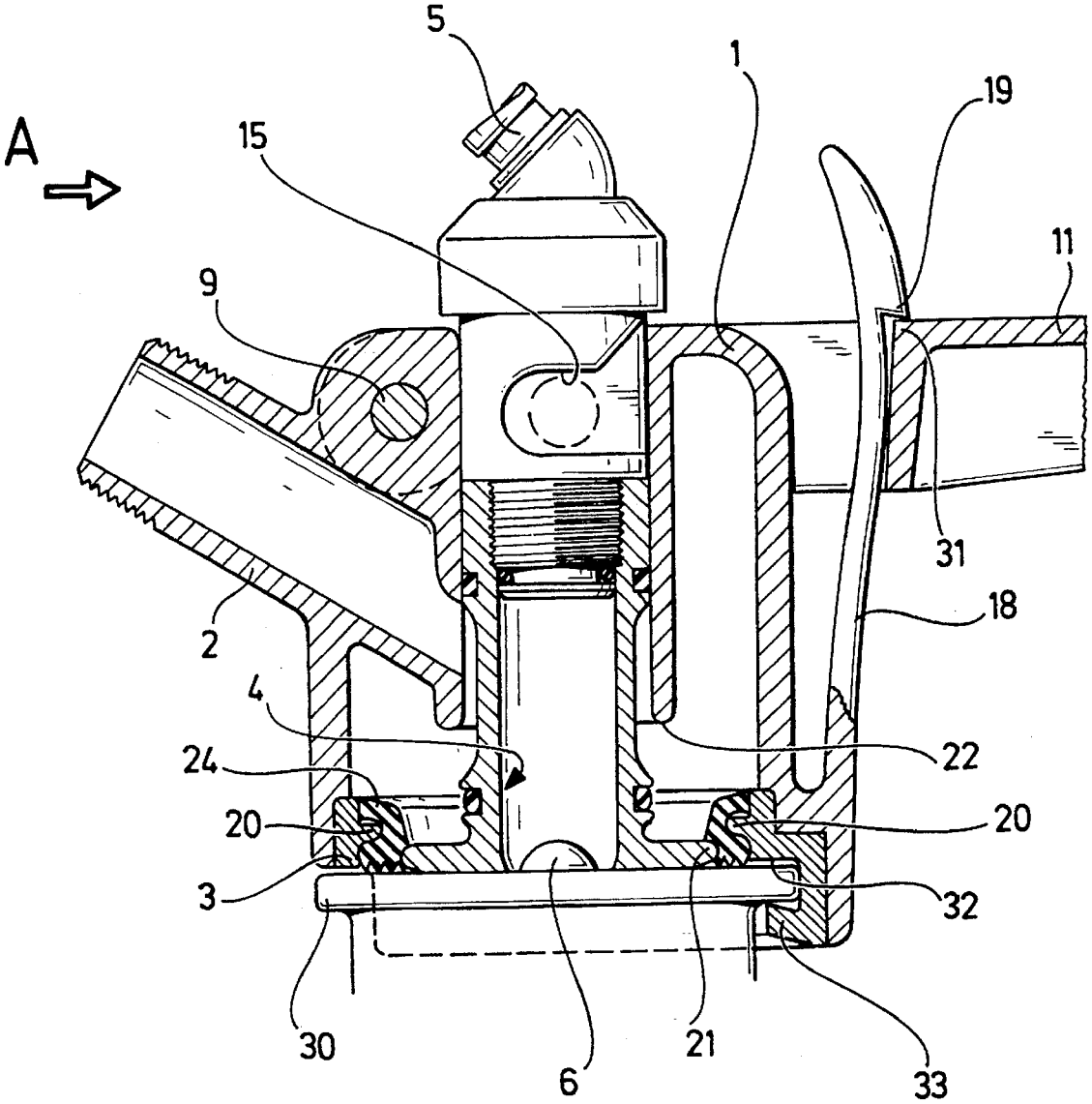

The tap head for keg fittings illustrated in the drawings comprises a housing 1 with a pipe connection 2 for introducing pressure gas, e.g., compressed air or $CO_2$, and a sliding guide means 3 arranged on the underside of the housing 1 for enabling the housing 1 to be pushed in the known manner onto the keg fittings of the barrel-like container, for example, a beer or lemonade container, and attached to them so that the tap head and the keg fittings are connected in a secure and sealed manner with one another.

An essentially hollow cylindrical slide 4 is displaceable in the housing 1 parallel to the longitudinal axis of the housing 1. A pipe connection 5 for the liquid to be tapped, for example, beer or lemonade, is arranged at the top of the slide 4. The slide 4 contains in its interior a loose, spherical valve body 6 which interacts with a valve seat (not illustrated) on the slide 4 and forms a check valve for the tapped liquid.

There is pivotally mounted on the housing 1 by means of a horizontal through bolt 9 an actuating lever 11 which has a relatively spacious recess 12 in the region of the housing 1 (cf. FIG. 3) with which it encircles the upper portion of the housing 1 such that it is pivotable back and forth between an upper position and a lower position. From the actuating lever 11 which is fork-shaped in the region of the recess 12, two pins 13, 14 project inwardly in the region of this recess 12 and engage in recesses 15 on both sides of the slide 4. As is apparent from FIGS. 1 and 2, the recesses 15 have openings which widen for insertion of the pins 13, 14.

When the actuating lever 11 is pivoted between its two extreme positions, the slide 4 is moved—via the pins 13, 14—with it. The upper position is the closed position of the tap head, the lower position the open position of the tap head. In the closed position, the tap head can be removed sideways from the keg fittings by means of the sliding guide means 3 or connected therewith. In the open position, the pipe connections 2, 5 are connected in a manner known per se with corresponding passages (not illustrated) in the keg fittings for gas and liquid, respectively.

There is integrally formed on the housing 1 which, in the illustrated embodiment, like the other parts of the tap head, consists of plastic, a spring tongue 18 (similarly made of plastic) which projects freely upwards and has a detent nose 19 in its upper region. As illustrated, the upper end of the spring tongue 18 constantly engages in the recess 12 of the actuating lever 11. When the actuating lever 11 is pivoted from its upper into its lower position (illustrated in FIGS. 1 and 2), the spring tongue 18 is elastically biased until its detent nose 19 is finally located above the upper side of the actuating lever 11. This detent nose 19 then protrudes over an associated detent edge 31 of the recess 12 (FIGS. 1, 2 and 3) and the actuating lever 11 is hereby locked in this lower position.

An annular collar 21 provided at the bottom of the slide 4 with openings (not illustrated) for passage of the gas can rest against an annular stop edge 22 of the housing portion 1 when the tap head is in its closed position. When the tap head is in its open position (FIGS. 1 and 2), a seal (not illustrated) provided at the bottom of the slide 4 serves to seal the slide 4 on the keg fittings in a manner known per se.

Figure 2:
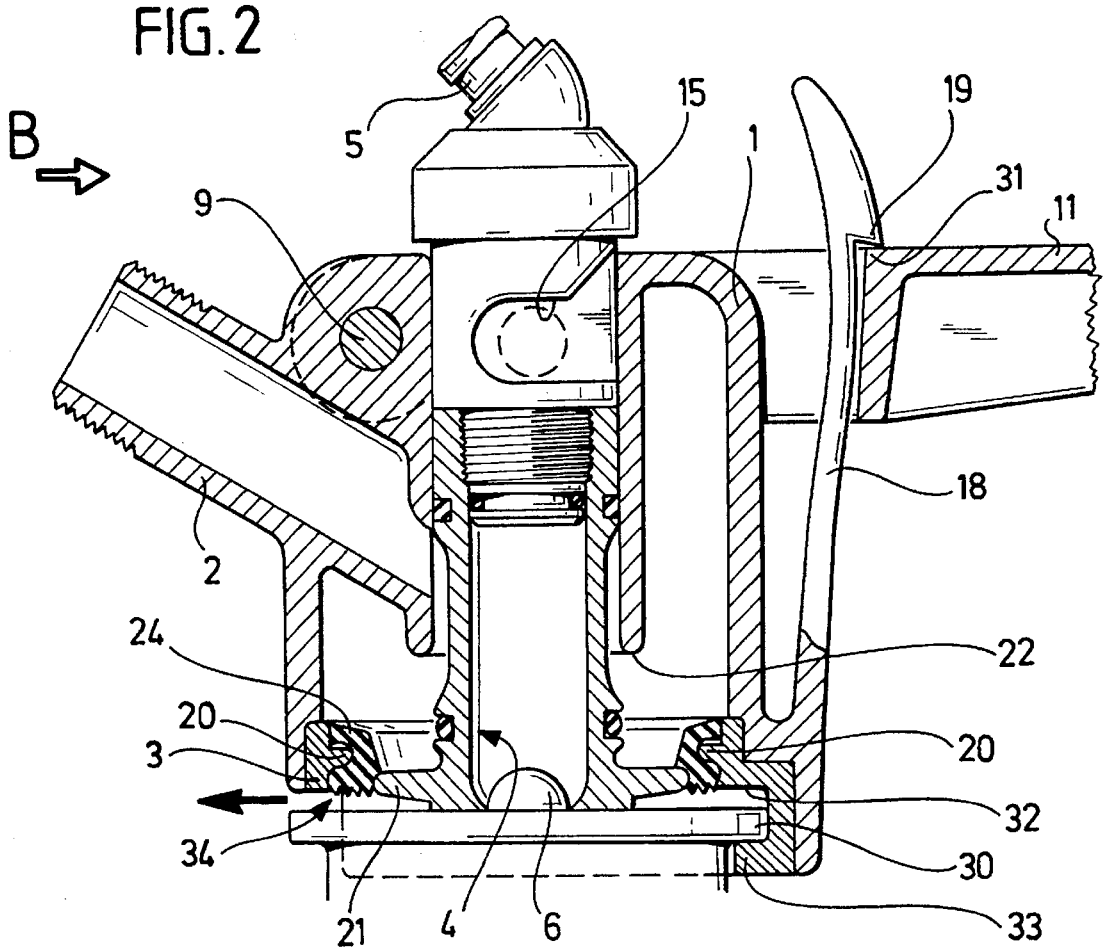
FIG. 2 shows the tap head of FIG. 1 in a position in which it is lifted off the keg fittings owing to excess gas pressure.

The sliding guide means 3 contains an annular seal 24 whose cross-sectional shape is apparent from FIGS. 1 and 2 and which likewise acts as a seal relative to the keg fittings. As illustrated, there is formed on the sliding guide means 3 an inwardly extending annular collar 20 which engages in an outwardly opening annular groove in the annular seal 24 and thereby serves as a support for this annular seal 24. When the slide 4 is pressed downwards by the actuating lever 11, with the tap head in its open position (FIGS. 1 and 2), the outer rim of the annular collar 21 provided on the slide 4 engages a conical inclined surface formed on the seal 24 and thereby presses this seal sealingly against a plate 30 of the keg fittings mounted on the barrel (FIG. 4).

Figure 3:
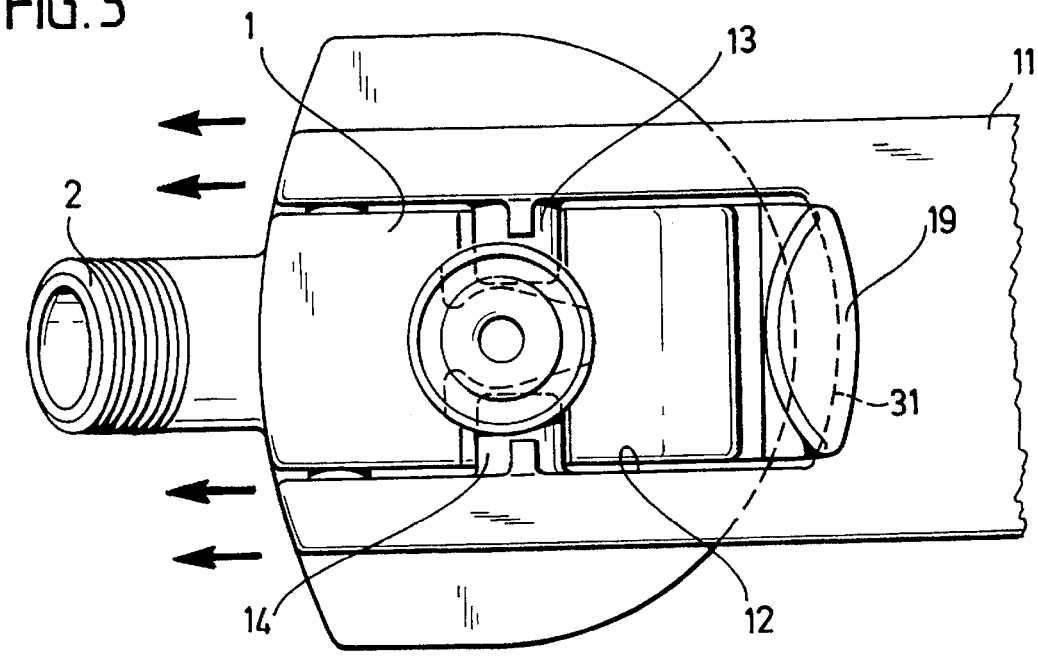
FIG. 3 is a plan view of the tap head of FIG. 2.

The sliding guide means 3 can be in the form of a spring elastic plastic part which is separate from the housing 1. The sliding guide means 3 is subsequently firmly connected to the housing 1 which, as a rule, will also consist of plastic, by being, for example, screwed, welded or adhesively joined to it. In the illustrated embodiment, the sliding guide means 3 whose outline is essentially apparent from FIG. 3, is inserted into a recess in the housing 1 which corresponds to this outline.

As is apparent from the drawings, the sliding guide means 3 comprises a U-shaped guideway 32 for the plate 30 of the keg fittings. The guideway is formed by an upper wall of the sliding guide means and an inwardly projecting guide piece 33 arranged at a distance below this wall. This groove-shaped guideway 32 is open towards the left in FIG. 1 and closed towards the right by the U-shaped bend to enable the tap head to be pushed from the right onto the plate 30 of the keg fittings. The guide piece 33 then engages under the rim of the plate 30. When the tap head is pushed onto the plate 30, the actuating lever 11 is in its upper position (not illustrated) and the tap head is, therefore, in its closed position.

Figure 4:
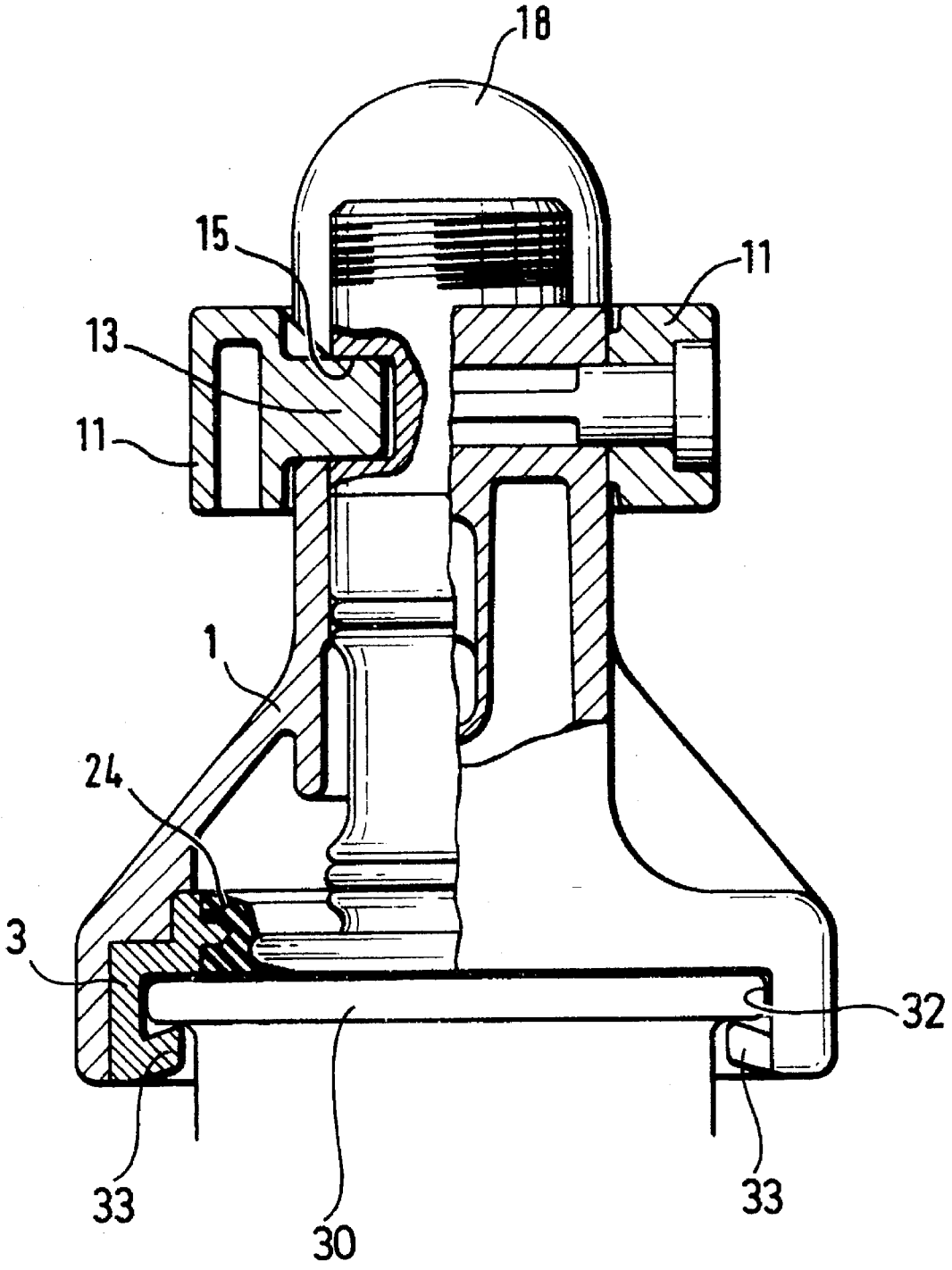
FIG. 4 is a part-sectional front view of the tap head with the pipe connection screwed off in the direction of arrow A in FIG. 1

In FIGS. 1 and 4, the tap head is clamped in its normal operating position on the plate 30 of the keg fittings. The annular seal 24 is firmly and sealingly pressed onto the surface of the plate 30 by the slide 4 which has been moved to its lower position so that liquid can be tapped in the usual way from the container provided with the keg fittings.

Figure 5:
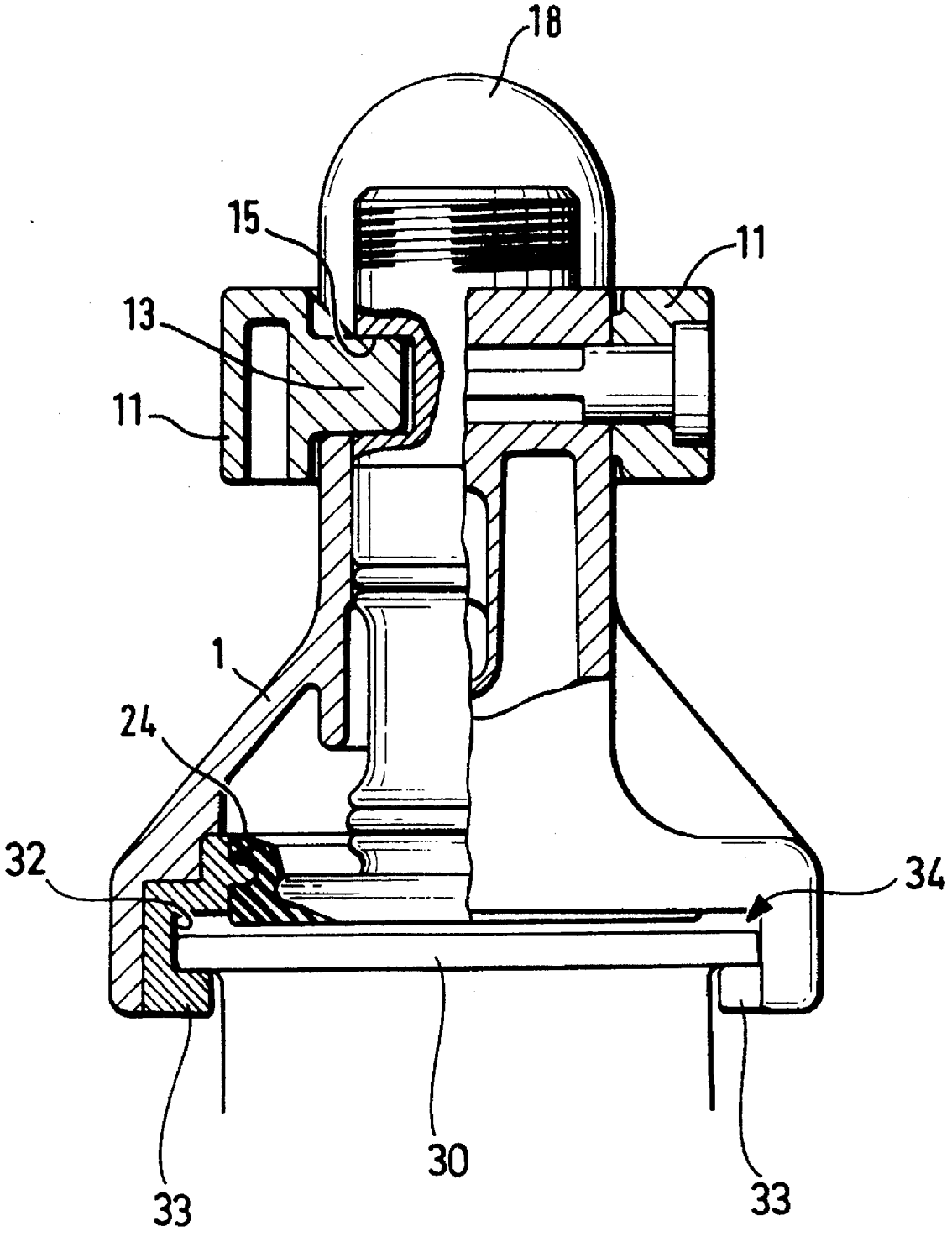
FIG. 5 is a front view of the tap head similar to FIG. 4 in the direction of arrow B in FIG. 2.

When an inadmissibly high gas pressure builds up in the housing 1 of the tap head and hence also in the container (keg) carrying the keg fittings via the pipe connection 2, for example, when the connection 2 is connected by a tube to a $CO_2$ bottle, with a pressure reducing valve interposed between these, and this pressure reducing valve is faulty, as illustrated in FIGS. 2 and 5, the housing 1 lifts with the annular seal 24 off the surface of the plate 30, thereby producing between annular seal 24 and plate 30 a gap 34 through which pressure gas can escape into the environment and an excess gas pressure can be released. The gas flowing out into the environment is indicated by arrows in FIGS. 2 and 3.

The resulting gap 34 can have a height of, for example, approximately 1 to 2 millimeters. The width of the gap (cf. FIG. 3) can be, for example, approximately 60 millimeters. The gap 34 thus forms a sufficiently large opening to allow a large amount of excess gas to escape rapidly and an inadmissible excess gas pressure to be reduced.

It has been found that owing to the large gap opening, foreign bodies, for example, ice, sugar residues or the like are blown away by the escaping gas. Clogging does, therefore, not occur. In contrast to separate pressure relief valves, the arrangement according to the invention wherein, if necessary, the entire tap head lifts off the keg fittings, therefore, operates in a self-cleaning and maintenance-free manner.

The opening pressure at which the tap head is to lift off the keg fittings can be set by appropriate design of the spring elastic guide piece 33 on which the rim of the plate 30 rests. It is possible to set the modulus of elasticity of the material forming the sliding guide means, in particular, plastic, and the geometry and the dimensions of this guide piece 33 such that the tap head lifts off at a desired gas pressure, thereby forming the gap 34, and hence acts as pressure relief valve. Normally, liquids are tapped from containers provided with keg fittings at an operating pressure of approximately 3 bar. The maximum admissible pressure in the tap head and in the container is approximately 7 bar. The guide piece 33 responsible for the lifting-off of the tap head is, therefore, designed such that the tap head lifts off at a pressure which is greater than approximately 7 bar.

The cross-section of the opening of gap 34 depends on the prevailing pressure, i.e., the gap opening becomes larger when the pressure is greater and vice-versa. This, again, is based on the elastic resilience of the guide piece 33 which engages under the rim of the plate 30 and under relaxed gas pressure conditions brings the sliding guide means 3 with the seal 24 back to the surface of the plate 30 again.

As illustrated in FIGS. 1 and 4, it is expedient for the guide piece 33 to be designed so as to extend upwards at an incline because it then undergoes deformation easily in the downward direction into the position illustrated in FIGS. 2 and 5 when an excess gas pressure occurs. In principle, the guide piece 33 can extend horizontally or even downwards under normal conditions, i.e., in the absence of excess gas pressure. This makes no difference to the fundamental way in which the tap head operates as "pressure relief valve".

In the illustrated embodiment, the tap head essentially consists entirely of plastic, i.e., apart from the sliding guide means 3 which consists of spring elastic plastic, the housing 1, the slide 4, the actuating lever 11 and the spring tongue 18 (integrally formed on the housing) are also made of plastic. In other embodiments of the invention, however, these parts may also consist of other materials, for example, metal, as long as the sliding guide means 3 with its guide piece 33 is made of spring elastic material or at least this guide piece 33 consists of spring elastic material so as to enable lifting-off of the tap head from the plate 30 of the keg fittings.

We claim:

1. Tap head for keg fittings comprising a housing, an annular seal arranged in the housing for sealing relative to the keg fittings, a slide movable in the housing, an actuating lever pivotally mounted on the housing and connected to the slide, releasable locking means for the actuating lever, connections for gas and liquid connectable via the slide with corresponding passages in the keg fittings, and a sliding guide means arranged on the underside of the housing and forming a guideway for pushing the tap head onto the protruding rim of a plate of the keg fittings which rests against the annular seal, at least the sliding guide means of the tap head consisting of spring elastic material and a projecting guide piece of the guideway engaging under the rim of the plate, characterized in that the modulus of elasticity of the material forming the sliding guide means (3) and the geometry and the dimensions of the guide piece (33) are determined such that at a certain gas pressure, the housing (1) of the tap head lifts off the plate (30) of the keg fittings, with the guide piece (33) thereby undergoing deformation, and a gap (34) through which excess gas pressure is releasable is thereby created between the plate (30) and the annular seal (24).

2. Tap head as defined in claim 1, characterized in that the gap (34) increases as the excess gas pressure rises, and closes again as the excess gas pressure drops.

3. Tap head as defined in claim 1, characterized in that the guide piece (33) engaging under the rim of the plate (30) extends upwards at an incline.

* * * * *